US011130218B2

(12) United States Patent
Hu

(10) Patent No.: US 11,130,218 B2
(45) Date of Patent: Sep. 28, 2021

(54) ELECTRIC QUICK ACTION WRENCH WITH SETTABLE TORQUE

(71) Applicant: Bobby Hu, Taichung (TW)

(72) Inventor: Bobby Hu, Taichung (TW)

( * ) Notice: Subject to any disclaimer, the term of this patent is extended or adjusted under 35 U.S.C. 154(b) by 252 days.

(21) Appl. No.: 16/589,876

(22) Filed: Oct. 1, 2019

(65) Prior Publication Data

US 2020/0171631 A1 Jun. 4, 2020

(30) Foreign Application Priority Data

Nov. 29, 2018 (TW) ..... 107142724

(51) Int. Cl.
*B25B 23/147* (2006.01)
*B25B 23/14* (2006.01)

(52) U.S. Cl.
CPC ..... *B25B 23/147* (2013.01); *B25B 23/141* (2013.01)

(58) Field of Classification Search
CPC ... B25B 23/147; B25B 23/14; B25B 23/1425; B25B 23/1427; B25B 1/00; B25B 23/141; B25B 23/142; B25B 21/008; B25B 23/157; B25B 23/461; B25B 13/462; B25B 13/46
See application file for complete search history.

(56) References Cited

U.S. PATENT DOCUMENTS 7,444,902 B1 11/2008 Lin et al.
2015/0059531 A1* 3/2015 Ely ..... B25B 21/004 81/57.39

FOREIGN PATENT DOCUMENTS

TW I600505 * 10/2017
TW I613047 * 6/2018

* cited by examiner

*Primary Examiner* — Robert J Scruggs
(74) *Attorney, Agent, or Firm* — WPAT, PC

(57) ABSTRACT

An electric quick action wrench with settable torque, which is operated in an electric mode or a manual mode, includes: a main body, a controller, a motor, a driving device, and a clutch device. The driving device is driven by the motor and combined with a fastener. The controller sets a threshold torque value. In the electric mode, when the fastener confronts a resistance larger than a clutch torque of the clutch device, the user is notified to switch to the manual mode through the notification of the clutch device. In the manual mode, when a manually output torque reaches the threshold torque value, the user is notified that the screwing operation has been finished by the notification of the clutch device. Thus, the safety of usage is achieved.

18 Claims, 7 Drawing Sheets

ELECTRIC QUICK ACTION WRENCH WITH SETTABLE TORQUE

BACKGROUND OF THE INVENTION

1. Field of the Invention

The present invention relates to electric quick action wrenches, and more particularly, to an electric quick action wrench with settable torque.

2. Description of the Related Art

As shown by published U.S. patent application No. 2008/0271574A1, a ratchet wrench tool interchangeable between manual and automatic operation mode is provided. In the electric operation mode, an electric hand grip having a motor placed therein is coupled to a rear end of a handle, and a first transmission rod is fittingly joined to an output spindle of the motor for transmitting the output power of the output spindle to the first transmission rod. A gear teeth of the first transmission rod is engaged with a locking pillar of a second transmission rod so as to drive the second transmission rod, thereby urging a ratchet head to rotate and facilitating the electrically assembling and disassembling operation. In the manual operation mode, a socket of a hand grip is fittingly connected to the first transmission rod of the handle. The socket is forced to turn by manually rotating the hand grip. Thus, the first transmission rod, the second transmission rod, and the ratchet head may be driven in turn to rotate, facilitating the manual assembling and disassembling operation.

The aforementioned ratchet wrench tool is optionally driven to remove a loosening object or fasten an object in electric operation mode or manual operation mode. However, during the process of removing or fastening the screws, if the wrench confronts a rusted or damaged screw, the object will be stuck and unable to move smoothly. Thus, the load of the motor is increased, which causes the motor to be overheating and damaged.

Further, the aforementioned ratchet wrench tool is incapable of notifying the user to stop operating when the motor reaches a high load. Thus, the motor is easily damaged during operation, increasingly risking the usage safety.

Moreover, the aforementioned ratchet wrench tool lacks a torque indicating function. As a result, the user is unable to know the currently applied torque in the manual operation, such that the rotating torque is easily excessive and causes the damages on the fastener or the to-be-fastened object.

SUMMARY OF THE INVENTION

For improving the aforementioned issue, an electric quick action wrench with settable torque is provided by the present invention. In the electric mode, when a ratchet mechanism confronts an excessive resistance, a clutch device is able to immediately detach a motor from the ratchet mechanism for effectively protecting the motor. Further, in the manual mode, during the screwing operation of a fastener, by applying a controller with the clutch device, a notification will be generated once the rotating torque becomes excessive.

In one embodiment of the present invention, an electric quick action wrench is provided, which is able to be operated by a user in an electric mode or a manual mode. The electric quick action wrench comprises:

a main body having a head portion, a handle portion, and a connection portion connected between the head portion and the handle portion;

a controller disposed in the main body and applied for setting a threshold torque value;

a power device disposed in the handle portion and electrically connected with the controller, wherein the power device comprises a power supply disposed in the handle portion, a motor electrically connected with the power supply, and a switch operable by a user to operate;

a driving device disposed in the main body, with an end of the driving device being connected with the power device for being driven by the motor, and another end of the driving device in opposite to the power device able to be connected with a fastener;

a torque sensing device disposed in the main body and electrically connected with the controller, wherein the torque sensing device is configured to detect a manually output torque when the electric quick action wrench is operated in the manual mode;

a clutch device disposed in the main body and positioned in the driving device, wherein the clutch device has a clutch torque and is able to be changed between an meshing state and a semi-clutch state.

In the electric mode, when a resistance confronted by the fastener exceeds the clutch torque, the clutch device is automatically enters a semi-clutch state. At that time, the user is notified to be aware of the semi-clutch notification indicating that the wrench should be changed to the manual mode. In the manual mode, when a value of the manually output torque reaches the threshold torque value, the controller restarts the power device to operate, and the clutch device enters the semi-clutch state again. At this time, the user is notified by the notification and aware of that the fastener is imposed with a sufficient fastening torque.

According to the abovementioned descriptions of the present invention, when the driving device confronts an excessive resistance in the electric mode, the clutch device immediately detaches the motor from the driving device. Then, the user is able to operate the wrench in the manual mode and force the fastener to leave the rust position. Thus, the protection of the motor and the safety of usage are achieved.

Further, the clutch device is able to generate a notification when the rotating torque is excessive. Thus, the user is prevented from imposing an excessive torque which may cause damages on the fastener or the to-be-fastened object.

In accordance with a further embodiment of the present invention, the torque sensing device further comprises an indicator electrically connected with the torque sensor and disposed between the handle portion and the connection portion of the main body; the indicator is configured to indicate the value of the manually output torque detected by the torque sensor. Thus, the user knows the currently applied torque in the manual mode, and is prevented from imposing an excessive torque which may cause damages on the fastener or the to-be-fastened object.

In accordance with a further embodiment of the present invention, the setting unit is configured for setting an indicative torque value which is set between eighty to ninety percent of the threshold torque value. When the value of the manually output torque reaches the indicative torque value, the controller restarts the motor to operate intermittently. The controller controls the motor to keep operating until the value of the manually output torque reaches the threshold torque value. Thus, when the rotating torque is detected as reaching the threshold torque value, precautionary notification is intermittently emitted to notify the user, thereby achieving the precautionary protection effects.

DETAILED DESCRIPTION OF THE INVENTION

Figure 1:
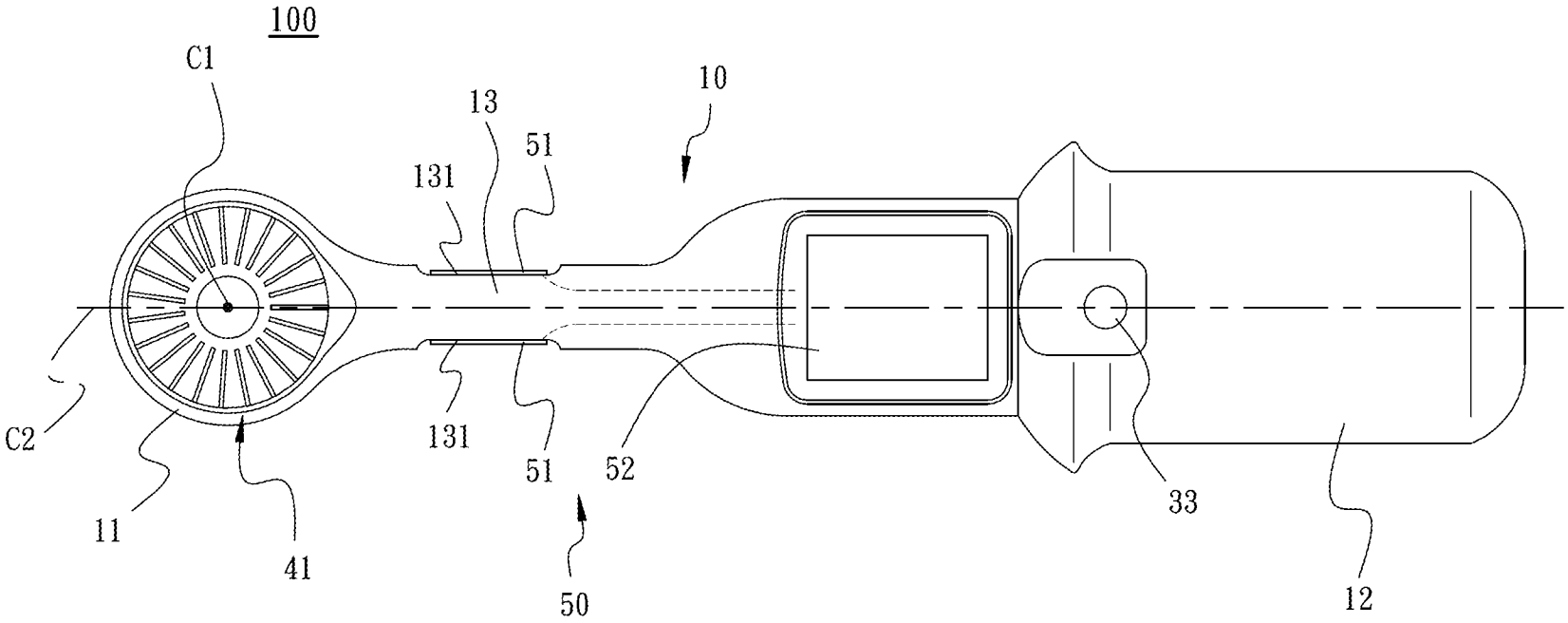
FIG. 1 is a top perspective view of the wrench in accordance with the first embodiment of the present invention.
Figure 2:
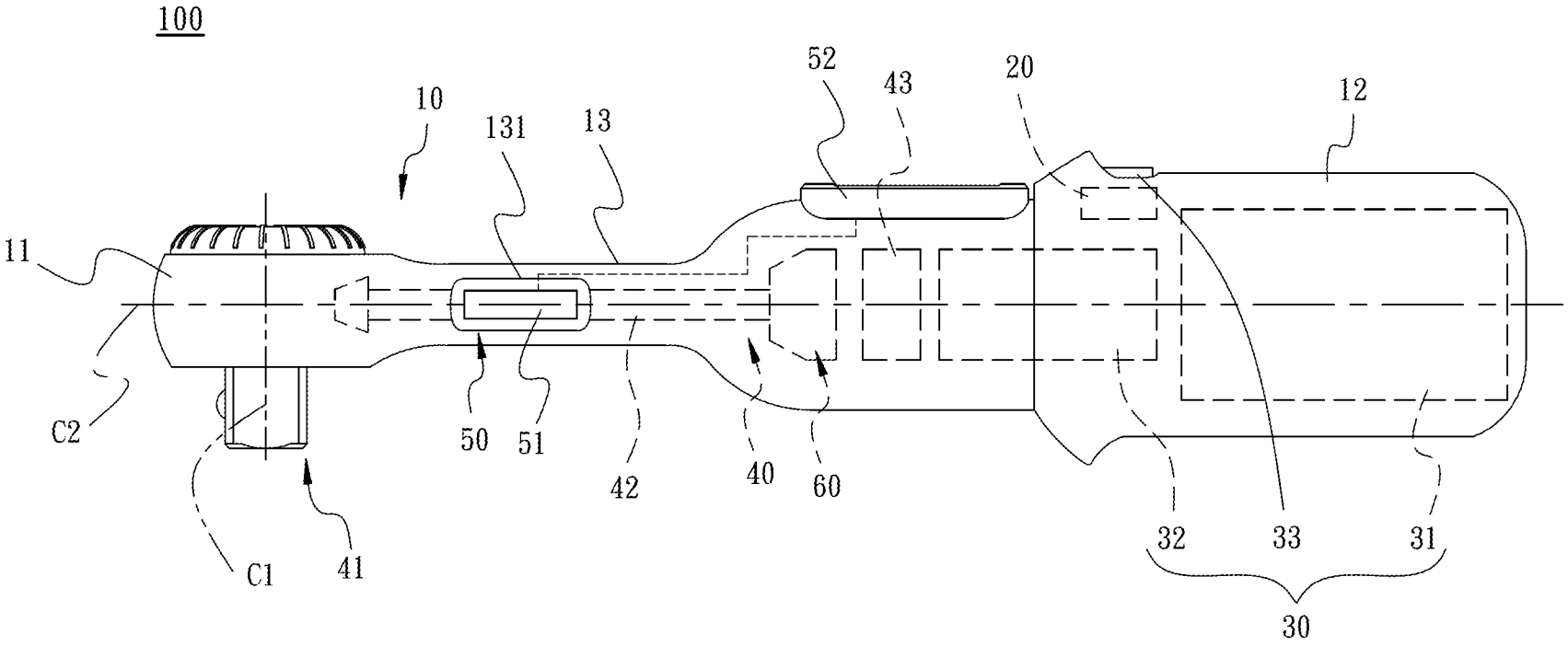
FIG. 2 is a side view of the wrench in accordance with the first embodiment of the present invention.
Figure 3:
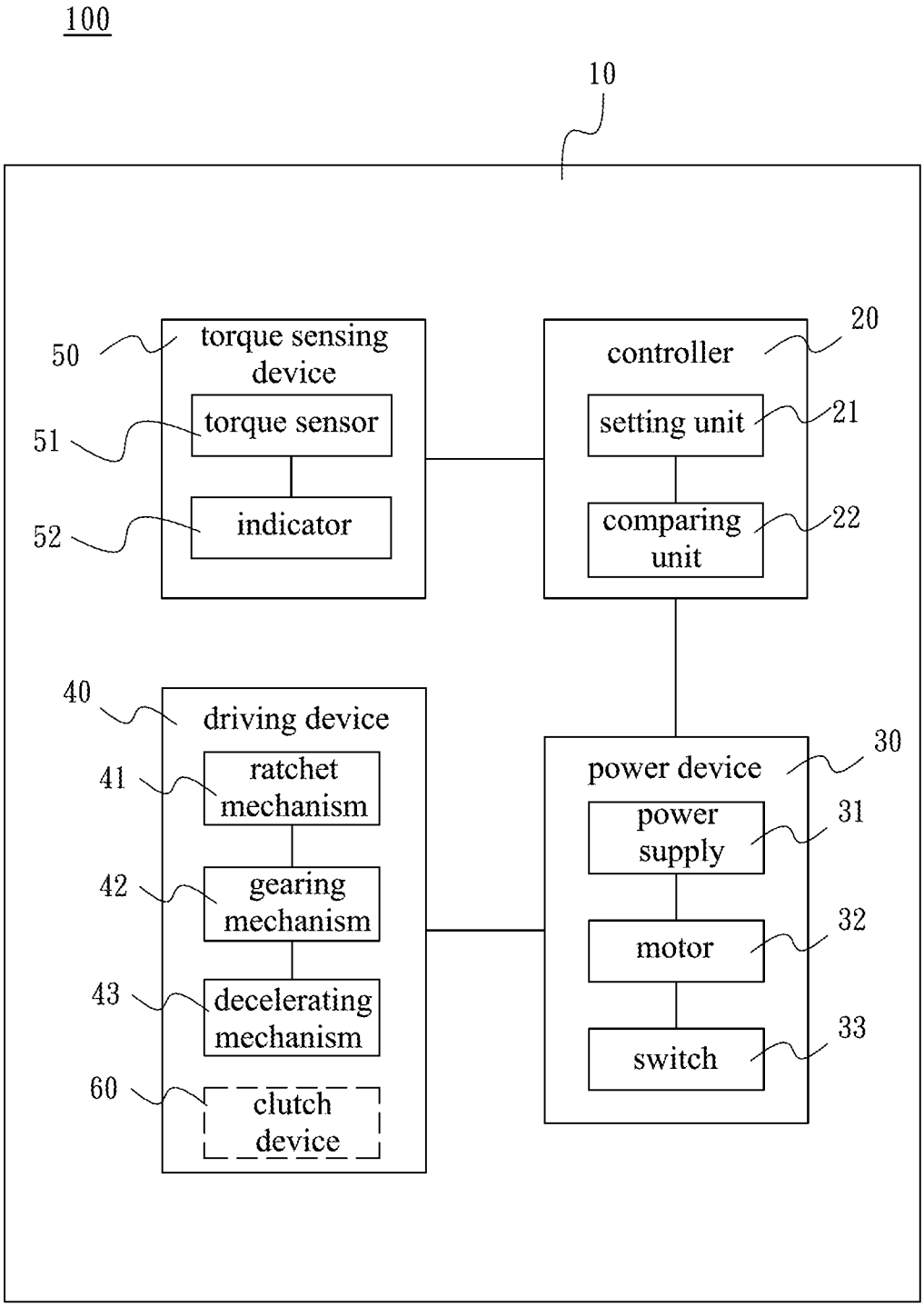
FIG. 3 is a schematic diagram illustrating the structure of the wrench in accordance with the first embodiment of the present invention.
Figure 4:
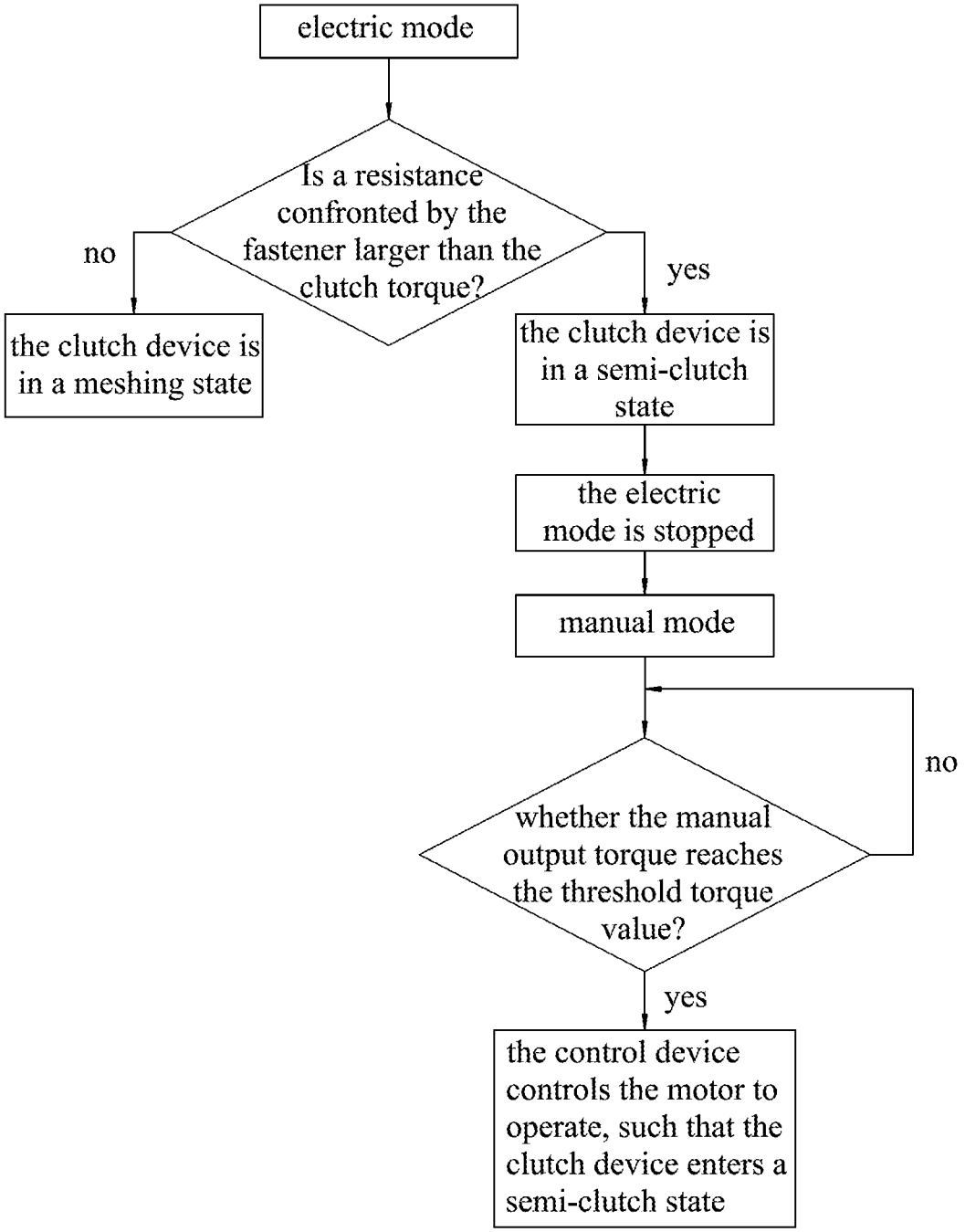
FIG. 4 is a flow chart of operating the wrench in accordance with the first embodiment of the present invention.

The aforementioned and further advantages and features of the present invention will be understood by reference to the description of the preferred embodiment in conjunction with the accompanying drawings where the components are illustrated based on a proportion for explanation but not subject to the actual component proportion. Embodiments of the present invention are illustrated in detail along with the drawings. However, the technical features included by the present invention are not limited to certain embodiments hereby provided. Scope of the present invention shall be referred to the claims, which include all the possible replacements, modifications, and equivalent features.

Referring to FIG. 1 to FIG. 4, an electric quick action wrench 100 with settable torque in accordance with the first embodiment of the present invention is provided, wherein the electric quick action wrench 100 is able to be operated by a user for rotating a fastener in an electric mode or a manual mode. In the electric mode, the electric quick action wrench 100 is able to drive the fastener to process the screwing operation in a quick action; in the manual mode, the electric quick action wrench 100 is applied for driving the fastener to process the screwing operation or to pass through a rust position, wherein the objective of the screwing operation is to screw the fastening on an to-be-fastened object.

In accordance with the present invention, the electric quick action wrench 100 comprises a main body 10, a controller 20, a power device 30, a driving device 40, a torque sensing device 50, and a clutch device 60.

The main body 10 has a head portion 11, a handle portion 12, and a connection portion 13 connected with the head portion 11 and the handle portion 12. The head portion 11 is perforated along a first axis C1. The handle portion 12 and the connection portion 13 are hollowed along a second axis C2 which is perpendicular to the first axis C1, such that the head portion 11, the handle portion 12 and the connection portion 13 are in internal communication. An end of the connection portion 13 adjacent to the head portion 11 has a width which is smaller than a width of the head portion 11, and the end of the connection portion 13 having the smaller width respectively has one planar area 131 on two sides thereof.

The controller 20 is disposed in the main body 10 and applied for setting a threshold torque value.

The power device 30 is disposed in the handle portion 12 and electrically connected with the controller 20, wherein the power device 30 comprises a power supply 31 disposed in the handle portion 12, a motor 32 electrically connected with the power supply 31, and a switch 33 for the user to operate. The power supply 31 is configured to provide the electricity required for the operation of the motor 32. The switch 33 is electrically connected with the controller 20, such that the controller 20 is applied for controlling the operation of the motor 32 through the switch 33. In the first embodiment, the power supply 31 is a battery.

The driving device 40 is disposed in the main body 10, with an end of the driving device 40 connected with the power device 30, so as to be driven by the motor 32. The other end of the driving device 40 opposite to the power device 30 is allowed to be connected with a fastener. When the user turns on the switch 33, the motor 32 starts to rotate and provides a power output torque to drive the driving device 40, so as to rotate the fastener for the quick screwing operation. Such operation mode is defined as the electric mode of the electric quick action wrench 100. When the user manually rotates the main body 10, the main body 10 synchronously drives the driving device 40 and the fastener to rotate about the first axis C1 as a rotation axis. Such operation mode is defined as the manual mode of the electric quick action wrench 100.

The driving device 40 comprises a ratchet mechanism 41 disposed on the head portion 11, and a gearing mechanism 42 connected between the ratchet mechanism 41 and the motor 32. The ratchet mechanism 41 is able to be combined with the fastener for carrying out the screwing operation in the electric mode or in the manual mode. The driving device 40 may, according to demand, further comprises a decelerating mechanism 43.

The torque sensing device 50 is disposed in the main body 10 and electrically connected with the controller 20, wherein the torque sensing device 50 is configured to detect a manually output torque when the electric quick action wrench 100 is operated in the manual mode. The torque sensing device 50 comprises at least one torque sensor 51 disposed on the connection portion 13 of the main body 10. The torque sensing device 50 has two torque sensors 51 in the first embodiment, wherein the two torque sensors 51 are positioned on the planar areas 131 at two sides of the connection portion 13 of the main body 10, respectively. The two torque sensors 51 are configured to transmit the detected data to the controller 20 for calculation. In the first embodiment, the torque sensors 51 are strain gauges. The two torque sensors 51 are adhered to the two planar areas 131 of the connection portion 13, and able to detect the manually output torque which the user applies to rotate the main body 10 under the screwing operation in the manual mode. The manually output torque refers a torque applied on the fastener when the user is rotating the main body 10 for driving the ratchet mechanism 41.

The controller 20 has a setting unit 21 and a comparing unit 22. The setting unit 21 is configured to set a threshold torque value, and the comparing unit 22 is configured to compare the detected torque value with the threshold torque value.

The torque sensing device 50 further comprises an indicator 52 disposed between the handle portion 12 and the connection portion 13 of the main body 10. The indicator 52 is electrically connected with the torque sensor 51 for indicating the torque value of the manually output torque detected by the torque sensor 51. The indicator 52 is able to indicate the value through a light signal or numbers, allowing the user to conveniently observe the torque during operation.

The clutch device 60 is disposed in the main body 10 and arranged at a proper position in the driving device 40. The clutch device 60 has a clutch torque smaller than the power output torque. When the power device 30 drives the driving device 40 to rotate the fastener, and if the resistance which the fastener confronts during rotation is smaller than the clutch torque, the clutch device 60 automatically enters a meshing state. When the resistance confronted by the fastener during rotation is larger than the clutch torque, the clutch device 60 automatically enters a semi-clutch state.

The components of the clutch device 60 generally comprises a stationary cam, a movable cam, and a spring which biasedly pushes toward a side of the movable cam. The spring forces the movable cam to be normally meshed with the stationary cam, forming the meshing state of the clutch device 60. When the stationary cam confronts an excessive resistance, the movable cam resists the biased pushing force of the spring, such that the movable cam is incapable of driving the stationary cam to form the semi-clutch state of the clutch device 60. The scope of the present invention is not limited to the structure formed of the abovementioned components. In the first embodiment, the clutch device 60 is, for exemplary purposes only, positioned in the driving device 40 and arranged between the gearing mechanism 42 and the deceleration mechanism 43. The clutch device 60 is positioned at a proper position in the driving device 40. In other words, as long as the clutch device 60 is arranged on a route between the motor 32 and the fastener, the abovementioned effects are facilitated.

In the electric mode, when the resistance confronted by the fastener during rotation is larger than the clutch torque, the clutch device 60 automatically enters a semi-clutch state, and the user is notified by the notification from the clutch device 60 and aware of that the wrench 100 should be changed to be operated in the manual mode. In the manual mode, if the value of the manually output torque reaches the threshold torque value set by the controller 20, the controller 20 restarts the power device 30 to operate, forcing the clutch device 60 to be in the semi-clutch state again. Meanwhile, the user is notified by the notification from the clutch device 60 and aware of that the fastener has reached the necessary screwing torque. When the clutch device 60 is in the semi-clutch state, the clutch device 60 is able to simultaneously emit a sound and vibration to notify the user.

In particular, during the quick screwing operation in the electric mode, when the ratchet mechanism 41 confronts a resistance which is smaller than the clutch torque of the clutch device 60 (for example, when the thread of the fastener is structurally intact or when the fastener is idling), the clutch device 60 enters the meshing state, so that the power output torque is able to rotate the ratchet mechanism 41 to rotate the fastener. When the ratchet mechanism 41 confronts rust position on the screwing route during the quick screwing operation, the fastener confronts the resistance caused by the rust during screwing, and is therefore incapable of rotating smoothly. At this time, when the ratchet mechanism 41 confronts a resistance which is larger than the clutch torque, the clutch device 60 is changed from the meshing state to the semi-clutch state due to a prestress force, and the motor 32 will be idling, such that the power output torque form the motor 32 is incapable of driving the ratchet mechanism 41. Now, the user is able to wrench the main body 10 to operate in the manual mode, so as to overcome the resistance confronted by the ratchet mechanism 41, so that the fastener is allowed to rotate smoothly again, and the clutch device 60 is changed from the semi-clutch state to the meshing state. Thus, the motor 32 is able to control the ratchet mechanism 41 to drive the fastener for continuing the quick screwing operation.

When the fastener is driven by the ratchet mechanism 41 to process the screwing operation in the electric mode, the resistance which the ratchet mechanism 41 confronts keeps increasing as the fastener is being gradually fastened. When the resistance confronted by the ratchet mechanism 41 is larger than the clutch torque, the clutch device 60 is changed from the meshing state to the semi-clutch state. Afterward, before the user operates the wrench 100 to rotate the fastener in manual mode, the user is able to manually stop the motor 32 rotating (for example, turn off the switch 33). That is, the electric mode is stopped before the wrench 100 is operated to screw the fastener in the manual mode, and then the user is allowed to wrench the main body 10 with manually output torque. During the process of screwing, when the comparing unit 22 determines that the manually output torque detected by the torque sensor 51 keeps increasing and reaches the threshold torque value, the comparing unit 22 restarts the motor 32 to operate. At this time, in the manual mode, the clutch device 60 enters the semi-clutch state again, and the clutch device 60 emits the sound and vibration to notify the user that the necessary torque is reached.

Thus, in accordance with the present invention, when the ratchet mechanism 41 confronts an excessive resistance in the electric mode, the clutch device 60 immediately forces the motor 32 to be detached from the ratchet mechanism 41. The user then switches to operate the wrench 100 in the manual mode, so as to remove the fastener from the rust position, thereby protecting the motor 32 and assuring the safety of usage.

Moreover, in the manual mode, when the rotating torque reaches the previously set torque value, through the cooperation of the controller 20 and the clutch device, the notification is emitted. Thus, the user is prevented from imposing an excessive torque which may cause damages on the fastener or the to-be-fastened object.

Figure 5:
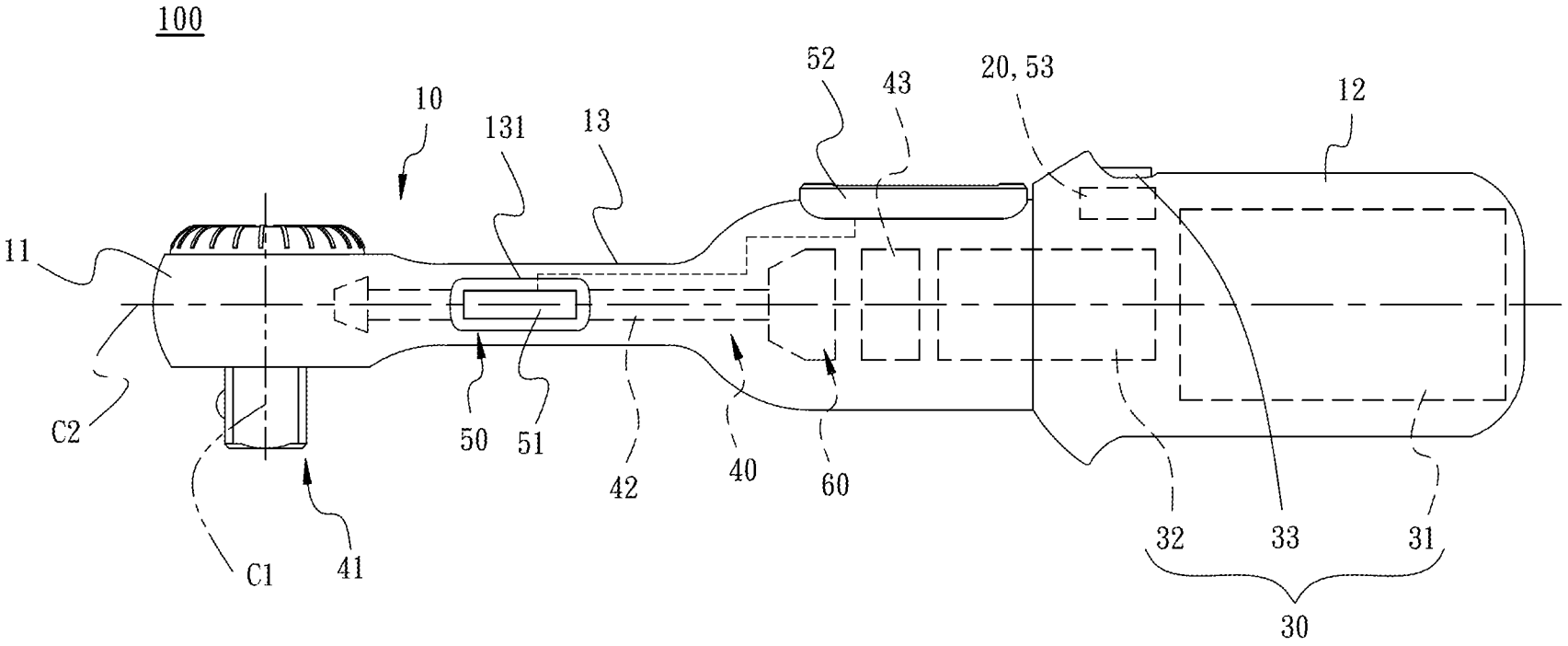
FIG. 5 is a side view of the wrench in accordance with a second embodiment of the present invention.
Figure 6:
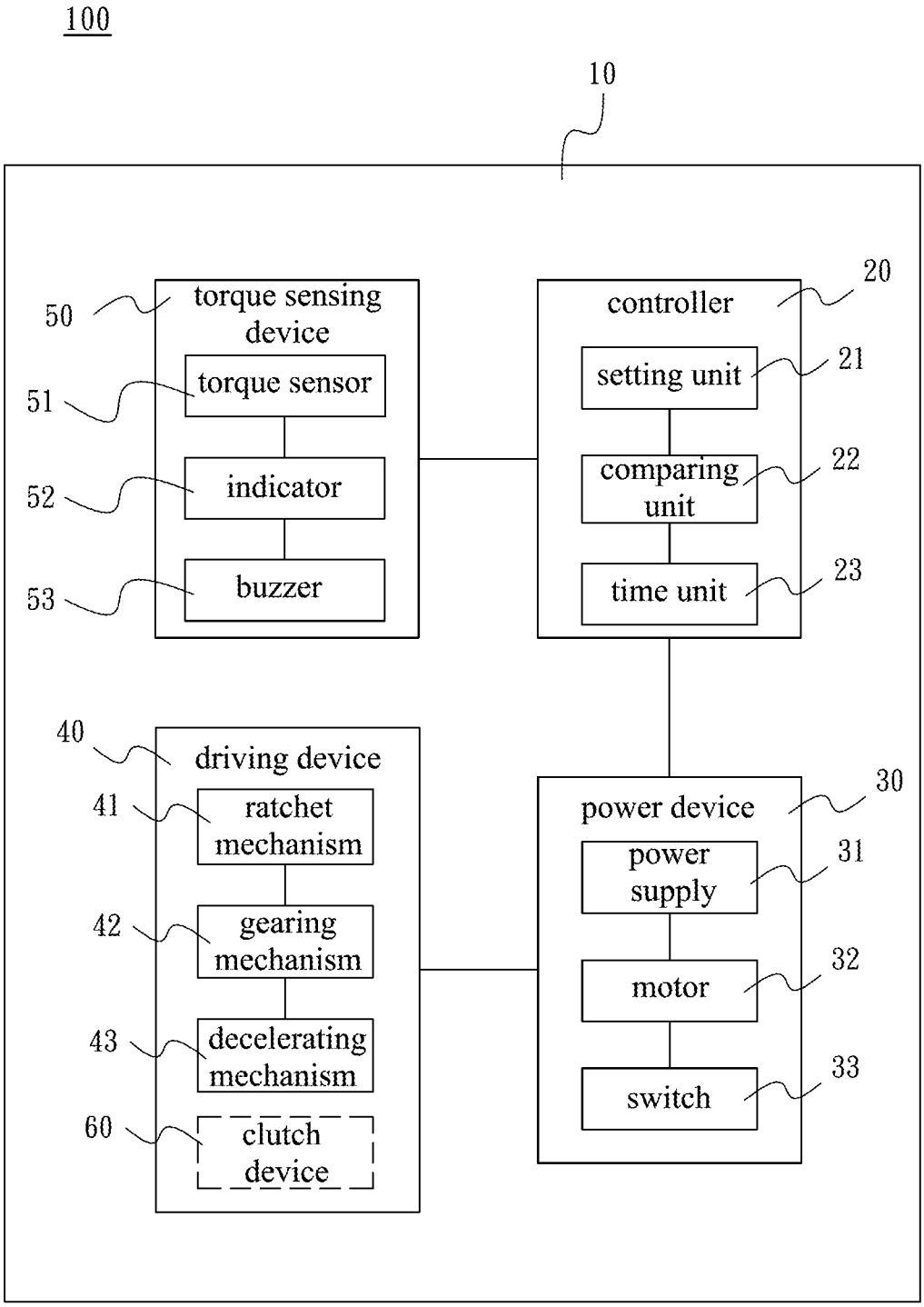
FIG. 6 is a schematic diagram illustrating the structure of the wrench in accordance with the second embodiment of the present invention.
Figure 7:
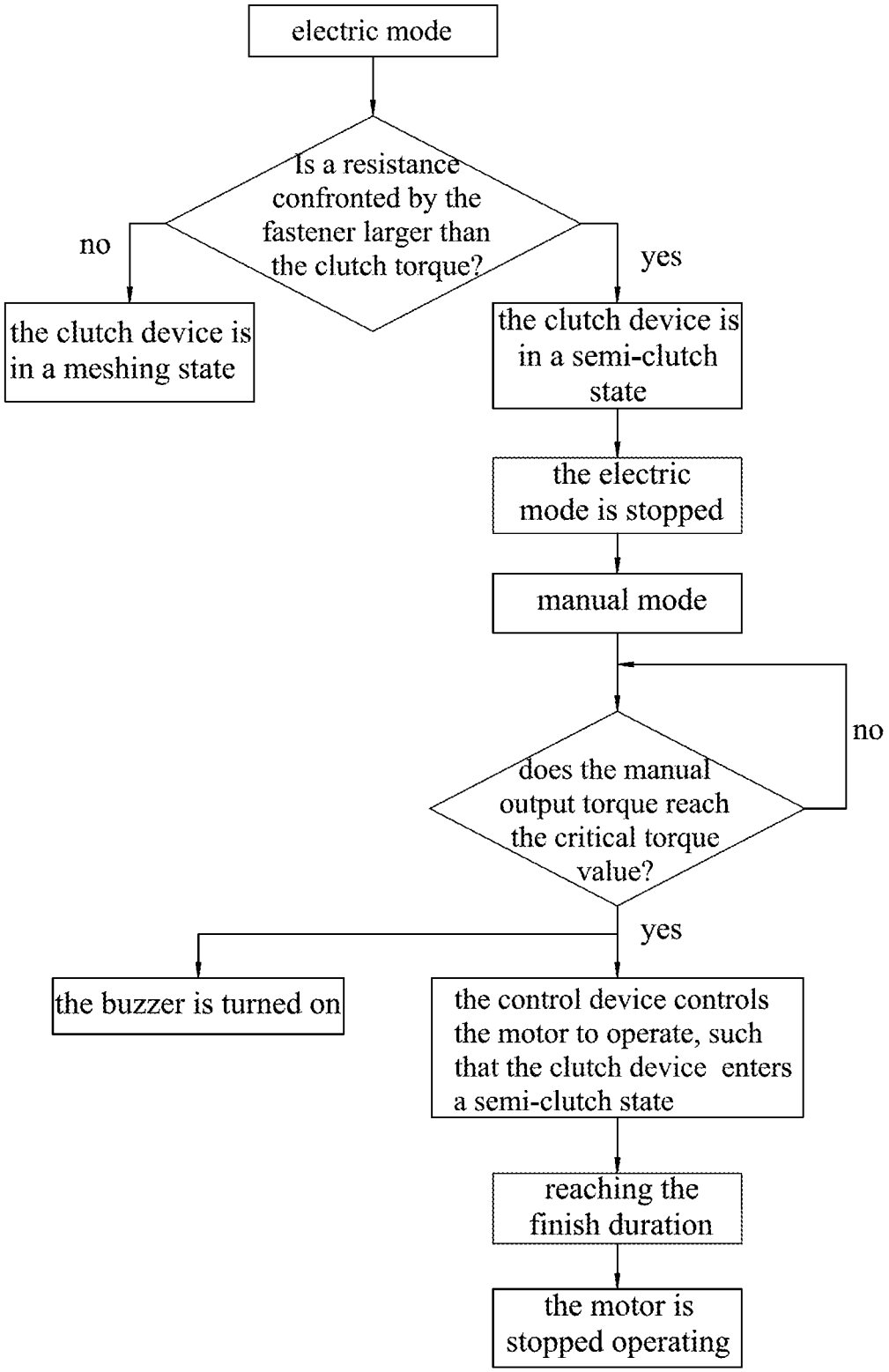
FIG. 7 is a flow chart of operating the wrench in accordance with the second embodiment of the present invention.

Referring to FIG. 5 to FIG. 7 illustrating the electric quick action wrench 100 in accordance with the second embodiment of the present invention, the differences between the second embodiment and the first embodiment are described as following.

The torque sensing device 50 further has a buzzer 53 which is electrically connected with the torque sensor 51 and the controller 20. During the screwing operation, when the comparing unit 22 of the controller 20 determines that the manually output torque detected by the torque sensor 51 increases and reaches the threshold torque value, the controller 20 turns on the buzzer 53 to emit a sound, and the clutch device 60 also emits the sound and vibration to effectively notify the user to stop imposing the excessive torque.

When the fastener is driven by the ratchet mechanism 41 to process the screwing operation in the electric mode, the motor 32, besides of being stopped manually, is also allowed to automatically stop in accordance with the present invention, which will be described below.

The controller 20 further has a time unit 23, which is configured to set a confirmation duration and a finish duration. When the fastener is to be applied for screwing, the user is able to manually carry out the screwing operation. When the comparing unit 22 determines that the manually output torque detected by the torque sensor 51 keeps increasing and the confirmation duration is reached, the comparing unit 22 controls the motor 21 to stop operating. Then, the user continuously wrenches the main body 10. When the comparing unit 22 determines that the manually output torque detected by the torque sensor 51 keeps increasing and reaches the threshold torque value, the controller 20 restarts the motor 32 to rotate, and the sound and vibration are emitted by the clutch device 60 to notify the user. Next, the controller 20 restarts the motor 32 to operate until the finish duration. When the finish duration is reached, the controller 20 stops the motor 32, finishing the screwing operation.

In the second embodiment, the setting unit 21 is configured to set an indicative torque value which is set between eighty to ninety percent of the threshold torque value. During the screwing operation, when the comparing unit 22 determines that the manually output torque detected by the torque sensor 51 reaches the range of the indicative torque value, the controller 20 restarts the motor 32 to operate intermittently. The controller 20 controls the motor 32 to continuously operate until the value of the manually output torque reaches the threshold torque value.

For instance, when the user manually wrenches the main body 10 in the manual mode to carry out the screwing operation, the manually output torque keeps increasing. When the comparing unit 22 determines that the manually output torque detected by the torque sensor 51 reaches the range of the indicative torque value, the controller 20 repeatedly controls the motor 32 to operate for 1 second and then stop for 1 second. During the operation of the motor 32, the clutch device 60 is in the semi-clutch state and emits the vibration and sound. Accordingly, the intermittent notification is generated for notifying the user that the current rotating torque is about to reach the threshold torque value. When the manually output torque reaches the threshold torque value, with the continuous operation of the motor 32, and the clutch device 60 emits continuous vibration and sound to notify the user to stop applying an excessive torque. Thus, with the indicative torque value set by the setting unit 21, the precautionary warning and protecting effects are achieved.

According to the descriptions above, the present invention achieves the effects below.

In the electric mode, when the fastener confronts the resistance which is bigger than the clutch torque, the clutch device 60 automatically enters the semi-clutch state, so that the user is notified to switch the wrench 100 to the manual mode according to the notification emitted by the clutch device 60. In the manual mode, when the manually output torque reaches the threshold torque value set by the controller 20, the controller 20 restarts the power device 30 to operate, so as to force the clutch device 60 to enter the semi-clutch state again. At that time, the user is notified and aware of that the fastener reaches the torque required for screwing according to the notification by the clutch device 60. When the clutch device 60 is in the semi-clutch state, the clutch device 60 emits the sound and vibration simultaneously for notifying the user.

During screwing operation of the fastener, the motor 32 is able to be stopped manually or automatically stop. During the screwing process, when the rotating manually output torque reaches the threshold torque value, the controller 20 controls the motor 32 to operate, and the clutch device 60 emits the indicative sound and vibration. Thus, the user is prevented from imposing an excessive torque which may cause damages on the fastener or the to-be-fastened object.

When the rotating torque is detected as reaching the threshold torque value, the controller 20 intermittently controls the motor 32 to operate, so as to force the clutch device 60 to intermittently emit the sound and vibration to notify the user, thereby achieving the precautionary protection effects.

During the process of the user wrenching the main body 10 in the manual mode, the indicator 52 is able to accurately indicate the torque imposed by the user, such that the user is able to adjust the operating torque accordingly. Thus, the user is prevented from imposing an excessive torque which may cause damages on the fastener or the to-be-fastened object.

When the ratchet mechanism 41 confronts an excessive resistance, the clutch device 60 immediately forces the motor 32 to be detached from the ratchet mechanism 41, such that the user is able to operate the wrench 100 in the manual mode for forcing the fastener to leave the rust position, thus achieving the effective protection upon the motor 32 and assuring the safety of usage.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An electric quick action wrench with settable torque, which is optionally operated in an electric mode and a manual mode by a user, the electric quick action wrench comprising:

a main body comprising a head portion, a handle portion, and a connection portion connected between the head portion and the handle portion;

a controller disposed in the main body and applied for setting a threshold torque value;

a power device disposed in the handle portion and electrically connected with the controller, the power device comprising a power supply disposed in the handle portion, a motor electrically connected with the power supply, and a switch operable by the user;

a driving device disposed in the main body, with one end of the driving device connected with the power device for being driven by the motor, and an end of the driving device away from the power device applied for being connected with a fastener;

a torque sensing device disposed in the main body and electrically connected with the controller, the torque sensing device applied for detecting a manually output torque when the electric quick action wrench is operated in the manual mode; and a clutch device disposed in the main body and arranged in the driving device, the clutch device having a clutch torque and switchable between a meshing state and a semi-clutch state, wherein, in the electric mode, when a resistance confronted by the fastener exceeds the clutch torque, the clutch device automatically enters the semi-clutch state, and the user is notified by a notification emitted by the clutch device and aware of that the wrench shall be changed to the manual mode; in the manual mode, when a value of the manually output torque reaches the threshold torque value, the controller restarts the power device to operate, and the clutch device enters the semi-clutch state again; at this time, the user is notified by a notification emitted by the clutch device and aware of that the fastener reaches a required screwing torque.

2. The electric quick action wrench of claim 1, wherein when the clutch device is in the semi-clutch state, the clutch device is able to emit a sound and vibration simultaneously to notify the user.

3. The electric quick action wrench with settable torque of claim 2, wherein the head portion is perforated along a first axis, and the handle portion and the connection portion are hollowed along a second axis which is perpendicular to the first axis, such that the head portion, the handle portion and the connection portion are in internal communication; the torque sensing device comprises at least one torque sensor disposed on the connection portion of the main body.

4. The electric quick action wrench of claim 3, wherein the power supply is a battery; the power supply is configured to provide an electricity required for an operation of the motor; the switch is electrically connected with the controller, such that the controller is applied for controlling the operation of the motor through the switch; when the user turns the switch on, the motor starts to rotate and provide a power output torque to drive the driving device, so as to rotate the fastener for a quick screwing operation, and such operation mode is the electric mode of the electric quick action wrench; when the user manually wrenches the main body, the main body synchronously drives the driving device and the fastener to rotate about the first axis which is as a rotation axis, and such operation mode is the manual mode of the electric quick action wrench; the electric mode is stopped before the wrench is to be operated in the manual mode; the driving device comprises a ratchet mechanism disposed on the head portion, and a gearing mechanism connected between the ratchet mechanism and the motor; the ratchet mechanism is able to be combined with the fastener for carrying out the screwing operation in the electric mode and the manual mode.

5. The electric quick action wrench of claim 4, wherein an end of the connection portion adjacent to the head portion has a width, which is smaller than a width of the head portion; an end of the connection portion having the smaller width respectively has one planar area on two sides; the torque sensing device has two torque sensors disposed at the two planar areas, respectively; the two torque sensors are configured to transmit a detected data to the controller for calculation; the torque sensors are strain gauges; the two torque sensors are adhered to the two planar areas, respectively.

6. The electric quick action wrench of claim 5, wherein the torque sensing device further comprises an indicator electrically connected with the torque sensor and disposed between the handle portion and the connection portion of the main body; the indicator is configured to indicate the value of the manually output torque detected by the torque sensor; the controller has a setting unit and a comparing unit; the setting unit is configured for setting the threshold torque value, and the comparing unit is configured for comparing the detected torque with the threshold torque value; the clutch torque is smaller than the power output torque, wherein at the time when the power device drives the driving device to rotate the fastener, if the resistance confronted by the fastener during rotating is smaller than the clutch torque, the clutch device automatically enters the meshing state.

7. The electric quick action wrench of claim 6, wherein the controller has a time unit, which is applied for setting a finish duration; when the motor is controlled by the controller to restart operating to reach the finish duration, the controller controls the motor to stop operating.

8. The electric quick action wrench of claim 7, wherein the controller is configured for setting a confirmation duration; when the manually output torque keeps increasing to reach the confirmation duration, the controller controls the motor to stop operating.

9. The electric quick action wrench of claim 8, wherein the setting unit is configured for setting an indicative torque value which is set between eighty to ninety percent of the threshold torque value; when the value of the manually output torque reaches the indicative torque value, the controller restarts the motor to operate intermittently; the controller controls the motor to keep operating until the value of the manually output torque reaches the threshold torque value.

10. The electric quick action wrench of claim 9, further comprising a buzzer, which is electrically connected with the torque sensing device and the controller; when the torque value of the manually output torque reaches the threshold torque value, the buzzer emits a sound.

11. The electric quick action wrench with settable torque of claim 1, wherein the head portion is perforated along a first axis, and the handle portion and the connection portion are hollowed along a second axis which is perpendicular to the first axis, such that the head portion, the handle portion and the connection portion are in internal communication; the torque sensing device comprises at least one torque sensor disposed on the connection portion of the main body.

12. The electric quick action wrench of claim 11, wherein the power supply is a battery; the power supply is configured to provide an electricity required for an operation of the motor; the switch is electrically connected with the controller, such that the controller is applied for controlling the operation of the motor through the switch; when the user turns the switch on, the motor starts to rotate and provide a power output torque to drive the driving device, so as to rotate the fastener for a quick screwing operation, and such operation mode is the electric mode of the electric quick action wrench; when the user manually wrenches the main body, the main body synchronously drives the driving device and the fastener to rotate about the first axis which is as a rotation axis, and such operation mode is the manual mode of the electric quick action wrench; the electric mode is stopped before the wrench is to be operated in the manual mode; the driving device comprises a ratchet mechanism disposed on the head portion, and a gearing mechanism connected between the ratchet mechanism and the motor; the ratchet mechanism is able to be combined with the fastener for carrying out the screwing operation in the electric mode and the manual mode.

13. The electric quick action wrench of claim 12, wherein an end of the connection portion adjacent to the head portion has a width, which is smaller than a width of the head portion; an end of the connection portion having the smaller width respectively has one planar area on two sides; the torque sensing device has two torque sensors disposed at the two planar areas, respectively; the two torque sensors are configured to transmit a detected data to the controller for calculation; the torque sensors are strain gauges; the two torque sensors are adhered to the two planar areas, respectively.

14. The electric quick action wrench of claim 13, wherein the torque sensing device further comprises an indicator electrically connected with the torque sensor and disposed between the handle portion and the connection portion of the main body; the indicator is configured to indicate the value of the manually output torque detected by the torque sensor; the controller has a setting unit and a comparing unit; the setting unit is configured for setting the threshold torque value, and the comparing unit is configured for comparing the detected torque with the threshold torque value; the clutch torque is smaller than the power output torque, wherein at the time when the power device drives the driving device to rotate the fastener, if the resistance confronted by the fastener during rotating is smaller than the clutch torque, the clutch device automatically enters the meshing state.

15. The electric quick action wrench of claim 14, wherein the controller has a time unit, which is applied for setting a finish duration; when the motor is controlled by the controller to restart operating to reach the finish duration, the controller controls the motor to stop operating.

16. The electric quick action wrench of claim 15, wherein the controller is configured for setting a confirmation duration; when the manually output torque keeps increasing to reach the confirmation duration, the controller controls the motor to stop operating.

17. The electric quick action wrench of claim 16, wherein the setting unit is configured for setting an indicative torque value which is set between eighty to ninety percent of the threshold torque value; when the value of the manually output torque reaches the indicative torque value, the controller restarts the motor to operate intermittently; the controller controls the motor to keep operating until the value of the manually output torque reaches the threshold torque value.

18. The electric quick action wrench of claim 17, further comprising a buzzer, which is electrically connected with the torque sensing device and the controller; when the torque value of the manually output torque reaches the threshold torque value, the buzzer emits a sound.

* * * * *